US010152071B2

(12) United States Patent
Ciomaga et al.

(10) Patent No.: US 10,152,071 B2
(45) Date of Patent: Dec. 11, 2018

(54) CHARGE INJECTION FOR ULTRA-FAST VOLTAGE CONTROL IN VOLTAGE REGULATORS

(71) Applicant: Dialog Semiconductor (UK) Limited, London (GB)

(72) Inventors: Dan Ciomaga, Ingolstadt (DE); Mihail Jefremow, Augsburg (DE); Stephan Drebinger, Munich (DE); Fabio Rigoni, Karlsfeld (DE)

(73) Assignee: Dialog Semiconductor (UK) Limited, London (GB)

( * ) Notice: Subject to any disclaimer, the term of this patent is extended or adjusted under 35 U.S.C. 154(b) by 0 days.

(21) Appl. No.: 15/356,993

(22) Filed: Nov. 21, 2016

(65) Prior Publication Data

US 2017/0269619 A1 Sep. 21, 2017

(30) Foreign Application Priority Data

Mar. 18, 2016 (DE) ..... 10 2016 204 571

(51) Int. Cl.
*G05F 1/575* (2006.01)
*G05F 1/565* (2006.01)
*G05F 1/56* (2006.01)

(52) U.S. Cl.
CPC ..... *G05F 1/575* (2013.01); *G05F 1/562* (2013.01); *G05F 1/565* (2013.01)

(58) Field of Classification Search
CPC ..... G05F 1/565; G05F 1/562; G05F 1/575
See application file for complete search history.

(56) References Cited

U.S. PATENT DOCUMENTS 9,170,593 B2 * 10/2015 Capofreddi ..... G05F 1/575
2010/0259235 A1 * 10/2010 Ozalevli ..... G05F 1/56 323/274
2014/0159683 A1 * 6/2014 Pan ..... G05F 1/575 323/280
2015/0198959 A1 * 7/2015 Kuttner ..... G05F 1/575 323/273
2016/0291619 A1 * 10/2016 Guan ..... G05F 1/575
2017/0060157 A1 * 3/2017 Jefremow ..... G05F 1/575
2017/0090494 A1 * 3/2017 Cui ..... G05F 1/562

* cited by examiner

*Primary Examiner* — Kyle J Moody
*Assistant Examiner* — Jye-June Lee
(74) *Attorney, Agent, or Firm* — Saile Ackerman LLC; Stephen B. Ackerman

(57) ABSTRACT

This application relates to a circuit for generating an output voltage and regulating the output voltage to a target voltage. The circuit includes a switchable voltage divider circuit configured to generate a feedback voltage that is a variable fraction of the output voltage, an error amplifier stage configured to generate a control voltage on the basis of a reference voltage and the variable fraction of the output voltage, a buffer stage configured to generate the output voltage on the basis of the control voltage, and a charge injection circuit configured to inject charge at an intermediate node between the error amplifier stage and the buffer stage to thereby modify the control voltage generated by the error amplifier stage. The application further relates to a method of operating such circuit.

18 Claims, 9 Drawing Sheets

CHARGE INJECTION FOR ULTRA-FAST VOLTAGE CONTROL IN VOLTAGE REGULATORS

TECHNICAL FIELD

This application relates to circuits and methods for generating an output voltage and regulating the output voltage to a target voltage. The application particularly relates to such circuits and methods that allow for fast and accurate control of a digitally controlled output voltage, e.g. in low-dropout regulators (LDOs).

BACKGROUND

State of the art power management integrated circuits (PMICs) commonly include voltage regulators, such as LDOs, for providing stable and accurately regulated supply rails. These voltage regulators drop an input voltage by a pass device to an output voltage $V_{out}$ to provide a regulated supply, free of noise. In to addition to providing static supply voltages, it may be desirable to have available dynamically controllable regulator output voltages, i.e. to have available voltage regulators that support voltage control, such as digital voltage control (DVC), for example. Such dynamic control of the regulator output voltages may be used to advantage to reduce power consumption of the overall system that include the PMIC.

Typical controllable voltage regulators (e.g., LDOs) include an error amplifier stage having an error amplifier and a buffer stage coupled (e.g. connected) in series. The error amplifier stage generates a control voltage that depends on a fixed reference voltage $V_{REF}$ and on a variable feedback voltage that can be adjusted for controlling the output voltage of the voltage regulator. The buffer stage receives the control voltage as an input and is thus controlled by the error amplifier stage. The buffer stage generates, as the output voltage of the voltage regulator, a voltage that depends on the control voltage.

The buffer stage in such voltage regulators typically has very high bandwidth and low output impedance to be able to drive high capacitive loads and react quickly on output load changes. On the other hand, the main loop including the error amplifier stage typically is designed for low bandwidth so as to contribute the dominant pole to the system. The output voltage of the voltage regulator may be controlled by adjusting the variable feedback voltage that is supplied to the error amplifier for comparison to the fixed reference voltage. As the buffer stage has very high bandwidth, the output voltage will follow the control voltage almost immediately. The speed with which the output voltage can be adjusted is thus determined by the bandwidth of the main loop including the error amplifier stage. Since the main loop error amplifier stage typically has low bandwidth, the change rate for the output voltage will be low as well.

The change rate of the output voltage might be increased by adding a fixed load to the output when controlling the output voltage. Adding such fixed load would increase the bias current in the error amplifier of the error amplifier stage and thus lead to a higher bandwidth of the main loop. However, since stability of the voltage regulator depends on the bias current of the error amplifier, the bandwidth of the main loop cannot be increased to values that would be required for a satisfactory change rate of the output voltage. Moreover, adding the fixed load to the output would also increase current consumption of the voltage regulator and thus decrease efficiency of the voltage regulator.

SUMMARY

Thus, there is a need for an improved circuit for generating an output voltage and regulating the output voltage to a target voltage, and for an improved method of generating an output voltage and regulating the output voltage to a target voltage. There further is a need for such circuit and method that enable stable and accurate regulation of the output voltage and fast response to changes in the desired target voltage. There further is a need for such circuit and method that avoid decrease of efficiency of voltage generation. In view of some or all of these needs, the present document proposes a circuit for generating an output voltage and regulating the output voltage to a target voltage and a method of generating an output voltage and regulating the output voltage to a target voltage, having the features of the respective independent claims.

An aspect of the disclosure relates to a circuit for generating an output voltage and regulating the output voltage to a (desired) target voltage. The circuit may be a LDO. The circuit may include a switchable voltage divider circuit configured to generate a voltage (feedback voltage) that is a variable fraction of the output voltage. In other words, the voltage and the output voltage may stand in a given (variable) ratio to each other, wherein the given ratio depends on the (numerical value of) the variable fraction. The target voltage may be a controllable target voltage and may be determined by the reference voltage and the (numerical value of the) variable fraction. For example, the target voltage may depend on, or substantially correspond, to the reference voltage divided by the variable fraction (i.e., its numerical value). To this end, the switchable voltage divider may be switchable in accordance with a digital control signal indicative of the respective desired target voltage. The circuit may further include an error amplifier stage configured to generate a control voltage on the basis of a reference voltage and the variable fraction of the output voltage. The error amplifier stage may include an error amplifier, such as, for example, an operational transconductance amplifier (OTA). The circuit may further include a buffer stage configured to generate the output voltage on the basis of the control voltage. The buffer stage may include a buffer amplifier, such as, for example, a level shifter (e.g., a level shifter with offset). The buffer stage may further include a pass device (e.g., pass transistor) for passing an output current. The buffer stage may include a feedback loop. For example, the buffer stage may receive the control voltage and the output voltage as inputs. The circuit may yet further include a charge injection circuit configured to inject charge at an intermediate node between the error amplifier stage (e.g., the error amplifier) and the buffer stage to thereby modify the control voltage generated by the error amplifier stage. Here, charge injection may generally refer to injection of negative charge or (virtual) injection of positive charge, the latter corresponding to taking out negative charge.

Configured as above, the circuit enables to raise or lower the control voltage with significantly higher change rate than would be achieved by control of the main loop including the error amplifier stage. Thus, the circuit allows to achieve fast, accurate, and stable control of the output voltage in accordance with the desired output voltage. In particular, fast regulation (i.e., a high change rate) of the output voltage can be achieved regardless of bandwidth of a main loop including the error amplifier stage, thus allowing for low bandwidth of the main loop. Low bandwidth of the main loop in turn allows to retain a dominant pole of the system and to perform stable and accurate regulation of the output voltage. At the same time, the circuit does not suffer from significant loss of efficiency.

In embodiments, the charge injection circuit may be configured to inject charge at the intermediate node in such a manner that the control voltage is lowered if the variable fraction of the output voltage is larger than the reference voltage and raised if the variable fraction of the output voltage is smaller than the reference voltage. Thereby, the comparatively slow regulation of the control voltage (and hence of the output voltage) by the error amplifier stage is enhanced, i.e. accelerated.

In embodiments, the charge injection circuit may include a (first) capacitive element. The charge injection circuit may further include a switching circuit configured to be switchable to a first configuration in which the capacitive element is disconnected from the intermediate node and coupled (e.g., connected) between the output voltage and a first voltage level below the output voltage. The switching circuit may be further switchable to a second configuration in which the capacitive element is coupled (e.g., connected) between the intermediate node and a second voltage level above the first voltage level. The first voltage level may be ground. The second voltage level may be generated by the switchable voltage divider circuit. Alternatively, the second voltage level may be generated by a reference voltage source. Such configured, the circuit features a simple and efficient implementation of the charge injection circuit for quickly raising the output voltage to the desired target value.

In embodiments, the circuit may further include a control logic for periodically switching the switching circuit between the first configuration and the second configuration while the fraction of the output voltage is below the reference voltage. The control logic may cease to switch the charge injection circuit between the first and second configurations once the fraction of the output voltage has reached (i.e., has been raised to the level of) the reference voltage. Thus, it is ensured that the desired target voltage can be quickly reached without overshoot.

In embodiments, the switching circuit may be further configured to be switchable to a third configuration in which the capacitive element is disconnected from the intermediate node and coupled (e.g., connected) between the output voltage and the second voltage level. The switching circuit may be further switchable to a fourth configuration in which the capacitive element is coupled (e.g., connected) between the intermediate node and the first voltage level. Such configured, the circuit features a simple and efficient implementation of the charge injection circuit for quickly lowering the output voltage to the desired target value.

In embodiments, the control logic may be further configured to periodically switch the switching circuit between the third configuration and the fourth configuration while the fraction of the output voltage is above the reference voltage. The control logic may cease to switch the charge injection circuit between the third and fourth configurations once the fraction of the output voltage has reached (i.e., has been lowered to the level of) the reference voltage. Thus, it is ensured that the desired target voltage can be quickly reached without undershoot.

In embodiments, the switching circuit may include a first switching element for switchably coupling (e.g., connecting) a first terminal of the capacitive element to the first voltage level. The switching circuit may further include a second switching element for switchably coupling (e.g., connecting) the first terminal of the capacitive element to the second voltage level. The switching circuit may further include a third switching element for switchably coupling (e.g., connecting) a second terminal of the capacitive element to the output voltage. The switching circuit may yet further include a fourth switching element for switchably coupling (e.g., connecting) the second terminal of the capacitive element to the intermediate node. The first to fourth switching elements may be transistors, for example. In the first configuration, the first and third switching elements may be closed (substantially conducting state) and the second and fourth switching elements may be open (substantially non-conducting state). In the second configuration, the first and third switching elements may be open and the second and fourth switching elements may be closed. In the third configuration, the second and third switching elements may be closed and the first and fourth switching elements may be open. In the fourth configuration, the second and third switching elements may be open and the first and fourth switching elements may be closed. Such configured, the circuit features a simple and efficient implementation of the switching circuit.

In embodiments, the circuit may further include a second capacitive element coupled (e.g., connected) between the intermediate node and a predetermined voltage level. The predetermined voltage level may be the first voltage level (e.g., ground). Thus, the second capacitive element may level electric charge with the first capacitive element when the switching circuit transitions to the second or fourth configurations to thereby raise or lower the voltage at the intermediate node, i.e., the control voltage.

In embodiments, a capacity (capacity value) of the second capacitive element may be larger than a capacity (capacity value) of the first capacitive element by a factor of ten or more. Thereby, an appropriate step size for raising or lowering the control voltage due to charge injection for each full cycle of operation of the charge injection at the intermediate node circuit can be ensured.

In embodiments, the charge injection circuit may include a controllable (switchable) current source, which are controlled e.g. by a fixed time duration to achieve a certain voltage ramp at the output.

Another aspect of the disclosure relates to a method of generating an output voltage and regulating the output voltage to a (desired) target voltage. The method may relate to controlling a respective circuit for generating an output voltage and regulating the output voltage to a target voltage, such as a LDO, for example. The method may include generating a voltage (feedback voltage) that is a variable fraction of the output voltage, for example in accordance with a control signal depending on a desired target voltage. The control signal may be a digital control signal. The method may further include generating a control voltage on the basis of a reference voltage and the variable fraction of the output voltage. The desired target voltage may be determined by the reference voltage and the (numerical value of the) variable fraction. For example, the desired target voltage may depend on, or substantially correspond to, the reference voltage divided by the variable fraction (i.e., its numerical value). The control voltage may be generated by means of an error amplifier stage. The error amplifier stage may include an error amplifier, such as, for example, an OTA. The method may further include buffering the control voltage to generate the output voltage. Buffering may be performed by means of a buffer stage including a buffer amplifier, such as, for example, a level shifter (e.g., a level shifter with offset). The buffer stage may include a pass device (e.g., pass transistor) for passing an output current. The buffer stage may include a feedback loop. For example, generating the output voltage may involve receiving the control voltage and the output voltage as inputs. The method may yet further include modifying the generated control voltage by means of charge injection, for example at an intermediate node between the error amplifier stage and the buffer stage. Here, charge injection may generally refer to injection of negative charge or (virtual) injection of positive charge, the latter corresponding to taking out negative charge.

In embodiments, modifying the control voltage may involve raising the control voltage if the variable fraction of the output voltage is smaller than the reference voltage and lowering the control voltage if the variable fraction of the output voltage is larger than the reference voltage.

In embodiments, charge injection may be performed using a (first) capacitive element. The method may further include comparing the variable fraction of the output voltage to the reference voltage. The method may yet further include, if the fraction of the output voltage is below the reference voltage, periodically switching between a first configuration in which the capacitive element is disconnected from a voltage level of the control voltage and coupled (e.g., connected) between the output voltage and a first voltage level below the output voltage, and a second configuration in which the capacitive element is coupled (e.g., connected) between the voltage level of the control voltage and a second voltage level above the first voltage level. The first voltage level may be ground. The second voltage level may be generated by the voltage divider circuit. Alternatively, the second voltage level may be generated by a reference voltage source.

In embodiments, the method may further include, if the fraction of the output voltage is above the reference voltage, periodically switching between a third configuration in which the capacitive element is disconnected from the voltage level of the control voltage and coupled (e.g., connected) between the output voltage and the second voltage level, and a fourth configuration in which the capacitive element is coupled (e.g., connected) between the voltage level of the control voltage and the first voltage level.

In embodiments, the method may further include switching a first switching element that switchably couples (e.g., connects) a first terminal of the capacitive element to the first voltage level. The method may further include switching a second switching element that switchably couples (e.g., connects) the first terminal of the capacitive element to the second voltage level. The method may further include switching a third switching element that switchably couples (e.g., connects) a second terminal of the capacitive element to the output voltage. The method may yet further include switching a fourth switching element that switchably couples (e.g., connects) the second terminal of the capacitive element to the voltage level of the control voltage.

In embodiments, charge injection may be performed by means of a controllable (switchable) current source.

Notably, the method may be applied to any of the circuits described above, for example as a method of operating these circuits.

It is understood that in the present document, the term "couple" or "coupled" refers to elements being in electrical communication with each other, whether directly connected e.g., via wires, or in some other manner.

Moreover, it will be appreciated that method steps and apparatus features may be interchanged in many ways. In particular, the details of the disclosed method can be implemented as an apparatus adapted to execute some or all or the steps of the method, and vice versa, as the skilled person will appreciate. In particular, it is understood that methods according to the disclosure relate to methods of operating the circuits according to the above embodiments and variations thereof, and that respective statements made with regard to the circuits likewise apply to the corresponding methods.

BRIEF DESCRIPTION OF THE DRAWINGS

Embodiments of the disclosure are explained below in an exemplary manner with reference to the accompanying drawings, wherein FIG. 1 schematically illustrates an example of a circuit for generating an output voltage and regulating the output voltage to a target voltage to which embodiments of the disclosure may be applied, FIG. 2 schematically illustrates another example of a circuit for generating an output voltage and regulating the output voltage to a target voltage to which embodiments of the disclosure may be applied, FIG. 3 schematically illustrates an example of a circuit for generating an output voltage and regulating the output voltage to a target voltage according to embodiments of the disclosure, FIG. 4 schematically illustrates another example of a circuit for generating an output voltage and regulating the output voltage to a target voltage according to embodiments of the disclosure, FIG. 5A and FIG. 5B schematically illustrate an example of operation of the circuit of FIG. 4 for a desired target voltage above the current output voltage, FIG. 6A and FIG. 6B schematically illustrate an example of operation of the circuit of FIG. 4 for a desired target voltage below the current output voltage.

DESCRIPTION

Figure 1:
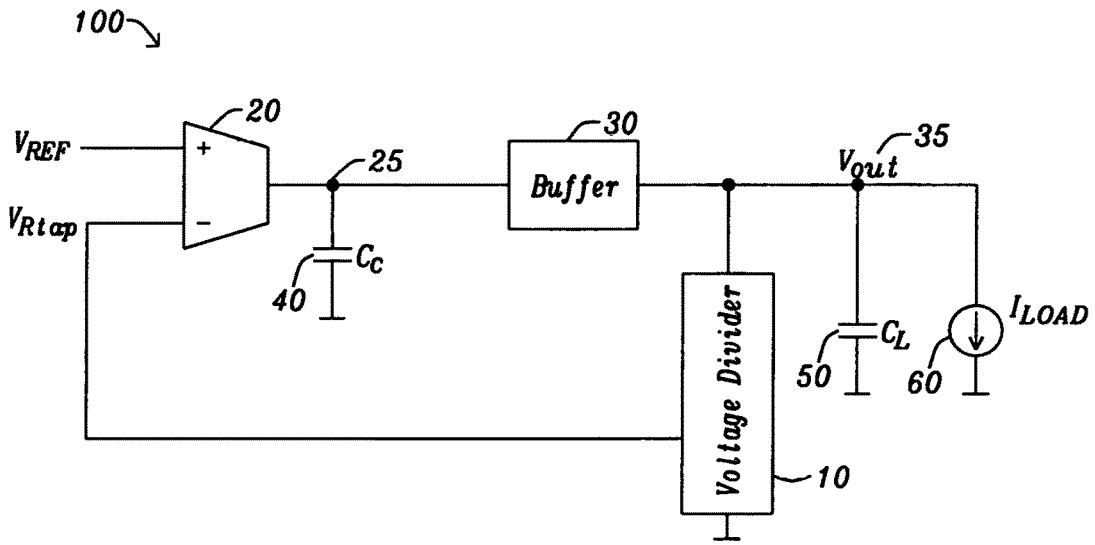
FIG. 1 Prior Art

An example of a voltage regulator 100 to which embodiments of the disclosure may be applied is schematically illustrated in FIG. 1. The voltage regulator 100 may be said to correspond to a circuit for generating an output voltage and regulating the output voltage to a target voltage. For example, the voltage regulator 100 may be a LDO. The voltage regulator 100 may comprise an error amplifier stage and a buffer stage 30 coupled (e.g., connected) in series with each other. The error amplifier stage may comprise an error amplifier 20. The error amplifier 20 may comprise, or be, an OTA. The voltage regulator 100 may further comprise a switchable voltage divider circuit 10 for generating a voltage $V_{Rtap}$ (feedback voltage) that is a fraction of the output voltage of the voltage regulator 100. The fraction may be a variable fraction that is adjustable by switching operation of the switchable voltage divider circuit 10, for example under control of a digital control signal. The feedback voltage $V_{Rtap}$ may be supplied to an input port (e.g., negative, or inverting input) of the error amplifier stage (e.g., of the error amplifier 20). A reference voltage $V_{REF}$ (e.g., fixed reference voltage) may be supplied to the other input port (e.g., positive, or non-inverting input) of the error amplifier stage (e.g., of the error amplifier 20).

The error amplifier stage may convert a differential input voltage (e.g., a difference between the reference voltage $V_{REF}$ and the feedback voltage $V_{Rtap}$) to a single-ended output. The error amplifier stage may generate, as the single-ended output, a control voltage $V_{control}$ that may be supplied to the buffer stage 30. Thus, the error amplifier stage may be said to generate the control voltage $V_{control}$ on the basis of the reference voltage $V_{REF}$ and the feedback voltage $V_{Rtap}$. The voltage regulator 100 may further comprise a capacitive element (compensation capacitive element) 40 connected between a predetermined voltage level (e.g., ground) and an intermediate node 25 between an output terminal of the error amplifier 20 and the buffer stage 30. The capacitive element 40 may have compensation capacitance $C_c$. The error amplifier stage may be said to include the capacitive element 40.

The buffer stage 30 may include a buffer amplifier, such as, for example, a level shifter (with or without offset). The buffer stage 30 may further include a pass device (pass transistor) of the voltage regulator 100 for passing an output current of the voltage regulator 100. The buffer stage 30 may output (e.g., generate), as the output voltage $V_{out}$, a voltage that depends on the control voltage $V_{control}$. Thus, the buffer stage 30 may be said to buffer the control voltage $V_{control}$ to generate the output voltage $V_{out}$. The buffer stage 30 may be further said to operate under control of the error amplifier stage (e.g., error amplifier 20). The output voltage $V_{out}$ output by the buffer stage 30 may correspond to the control voltage $V_{control}$ (e.g., may be equal to said voltage), or may be offset from the control voltage $V_{control}$ by a voltage offset (e.g., constant offset, such as an offset resulting from a threshold voltage of a transistor comprised by the buffer stage 30). The output voltage $V_{out}$ may be output at an output node 35 of the voltage regulator 100.

The buffer stage 30 may have high bandwidth and low output impedance in order to be able to drive an electrical load 60 that has (high) load capacitance (CO 50. The buffer stage 30 regulates $V_{out}$ based on the control voltage $V_{control}$. By contrast, the error amplifier stage (e.g., the error amplifier 20) may be designed for low bandwidth so as to provide for a dominant pole in the system connected to the compensation capacitance element 40. Thus, the main loop of the voltage regulator 100, which includes the error amplifier stage, may have much lower bandwidth than the buffer loop which includes the buffer stage 30.

In the voltage regulator 100, the output voltage $V_{out}$ may be controlled by controlling the variable fraction of the output voltage $V_{out}$ that is output by the switchable voltage divider circuit 10 as the feedback voltage $V_{Rtap}$. In other words, the output voltage $V_{out}$ may be controlled by changing the divider ratio of the switchable voltage divider circuit 10. As indicated above, the value of the variable fraction may be controlled by switching operation of the switchable voltage divider circuit 10. Said switching operation may be performed in accordance with (e.g., under control of) a digital control signal for setting the desired target voltage of the voltage regulator 100. Thus, the switchable voltage divider circuit 10 may be said to generate the feedback voltage in accordance with a (digital) control signal that depends (or is indicative of) the desired target voltage.

If the value of said variable fraction is increased, the error amplifier stage will regulate the control voltage $V_{control}$ (and thus, the output voltage $V_{out}$), such that the increased feedback voltage $V_{Rtap}$ given by the increased fraction of the output voltage $V_{out}$ and the reference voltage $V_{REF}$ agree with each other. That is, the control voltage $V_{control}$ output by the error amplifier stage will be reduced, and thus the output voltage $V_{out}$ will be reduced. On the other hand, if the value of said variable fraction is decreased, the error amplifier stage will regulate the control voltage $V_{control}$ (and thus, the output voltage $V_{out}$), such that the decreased feedback voltage $V_{Rtap}$ given by the decreased fraction of the output voltage $V_{out}$ and the reference voltage $V_{REF}$ agree with each other. That is, the control voltage $V_{control}$ output by the error amplifier stage will be increased, and thus the output voltage $V_{out}$ will be increased. As a result, the output voltage $V_{out}$ may be controlled to agree with the desired target voltage that may depend on (e.g., may be substantially given by) the reference voltage $V_{REF}$ divided by the present value of the variable fraction.

As the buffer stage 30 may have very high bandwidth, the output voltage $V_{out}$ will follow the control voltage $V_{control}$ almost immediately. Therefore, the speed of the output voltage change (change rate) is determined essentially by the bandwidth of the error amplifier stage (e.g., error amplifier 20), which is given by the bias current of the error amplifier 20 and the compensation capacitance $C_c$.

Figure 2:
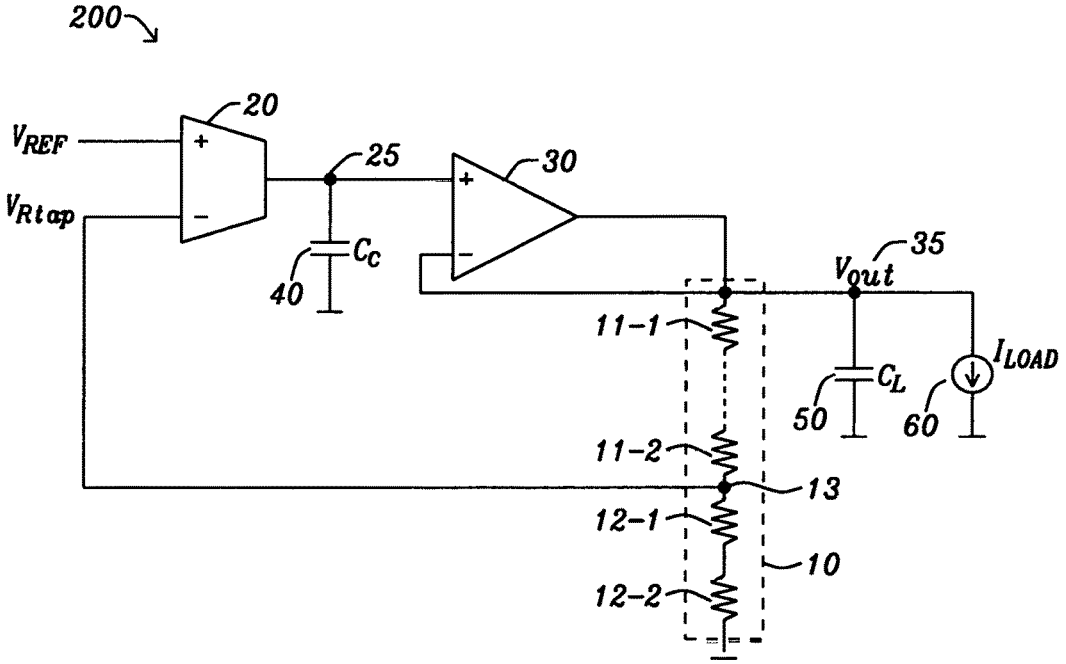
FIG. 2 Prior Art

Another example of a voltage regulator 200 to which embodiments of the disclosure may be applied is schematically illustrated in FIG. 2. The voltage regulator 200 of FIG. 2 may be seen as an exemplary, specific implementation of the voltage regulator 100 of FIG. 1. Single or plural details of implementation of the below description may be employed in the context of the voltage regulator 100 of FIG. 1, without the necessity to employ each and every detail of implementation. Some of these details of implementation relate to the switchable voltage divider circuit 10 and to the buffer stage 30. Moreover, unless indicated otherwise, like-numbered elements in FIG. 1 and FIG. 2 are identical and repeated description thereof is omitted for reasons of conciseness.

The switchable voltage divider circuit 10 in the voltage regulator 200 of FIG. 2 may comprise a plurality of resistance elements (e.g., resistors) 11-1, 11-2, 12-1, 12-2 that are coupled (e.g., connected) in series between a voltage level of the output voltage $V_{out}$ and ground. Alternatively, the switchable voltage divider circuit 10 may comprise a plurality of capacitive elements instead of resistive elements. The feedback voltage $V_{Rtap}$ may be output from (e.g., tapped at) an intermediate node 13 of the switchable voltage divider circuit 10. The plurality of resistance elements 11-1, 11-2 coupled (e.g., connected) between the intermediate node 13 and the voltage level of the output voltage $V_{out}$ may be switchable, so that a total resistance value of a circuit path between the intermediate node 13 and the voltage level of the output voltage $V_{out}$ may be controlled by switching of these resistance elements 11-1, 11-2. Switching of these resistance elements 11-1, 11-2 may involve selectively bypassing respective resistance elements.

The buffer stage 30 in the voltage regulator 200 of FIG. 2 may comprise a feedback loop. In other words, the buffer stage 30 may receive the generated output voltage $V_{out}$ and the control voltage $V_{control}$ as inputs. For example, the buffer stage 30 may comprise a buffer amplifier, and the output voltage $V_{out}$ output by the buffer amplifier may be fed back to an input port (e.g., the negative, or inverting input) of the buffer amplifier. The control voltage $V_{control}$ may be supplied to the other input port (e.g., the positive, or non-inverting input) of the buffer amplifier.

Next, embodiments of the disclosure will be described with reference to FIG. 3 to FIG. 8. Notably, embodiments of the disclosure may be applied to either voltage regulator described above.

Broadly speaking, the concept of the present disclosure relates to charge injection to the output of the error amplifier stage (e.g., error amplifier 20) by a charge injection circuit 70 to thereby simultaneously increase the change rate of the control voltage $V_{control}$ and of the output voltage $V_{out}$.

Figure 3:
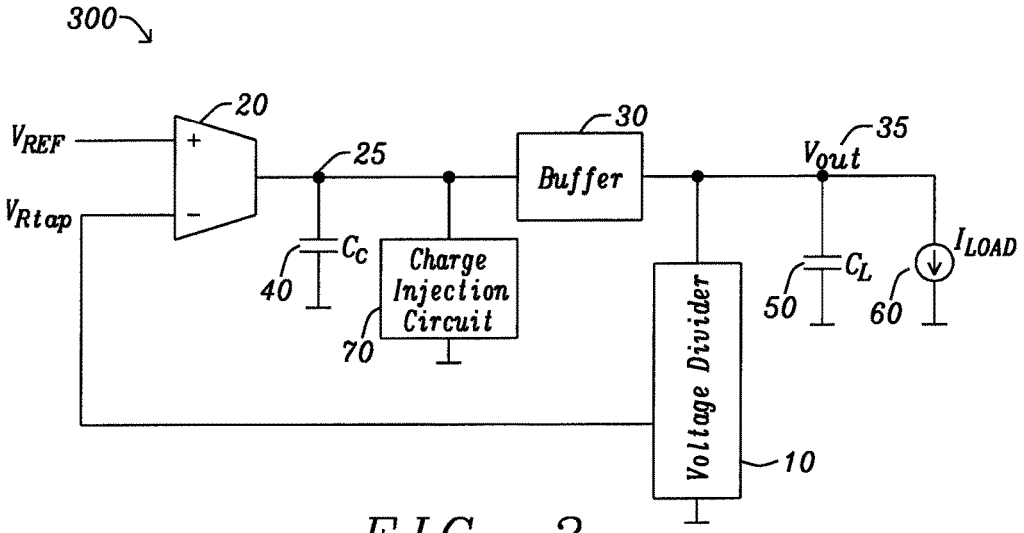

FIG. 3 schematically illustrates an example of a voltage regulator 300 according to embodiments of the disclosure. The voltage regulator 300 may be said to correspond to a circuit for generating an output voltage and regulating the output voltage to a target voltage.

The voltage regulator 300 differs from the voltage regulator 100 in FIG. 1 by comprising a charge injection circuit 70 for injecting (positive or negative) charge (i.e., electric charge) at the intermediate node 25. The charge injection circuit 70 may be coupled (e.g., connected) between the intermediate node 25 and a first voltage level (e.g., ground). Charge injection at the intermediate node 25 may serve to modify (adjust) the control voltage $V_{control}$ that is output by the error amplifier stage (e.g., error amplifier 20). The buffer stage 30 may operate under control of the modified control voltage.

The charge injection circuit 70 may be configured to inject electric charge at the intermediate node 25. In particular, the charge injection circuit 70 may be configured to inject electric charge in such a manner that the modified control voltage is lower than the control voltage generated by the error amplifier stage, i.e. such that the control voltage is lowered, if the feedback voltage $V_{Rtap}$ is larger than the reference voltage $V_{REF}$. The charge injection circuit 70 may be also configured to inject charge at the intermediate node 25 in such a manner that the modified control voltage is higher than the control voltage generated by the error amplifier stage, i.e. such that the control voltage is raised, if the feedback voltage $V_{Rtap}$ is smaller than the reference voltage $V_{REF}$.

Figure 4:
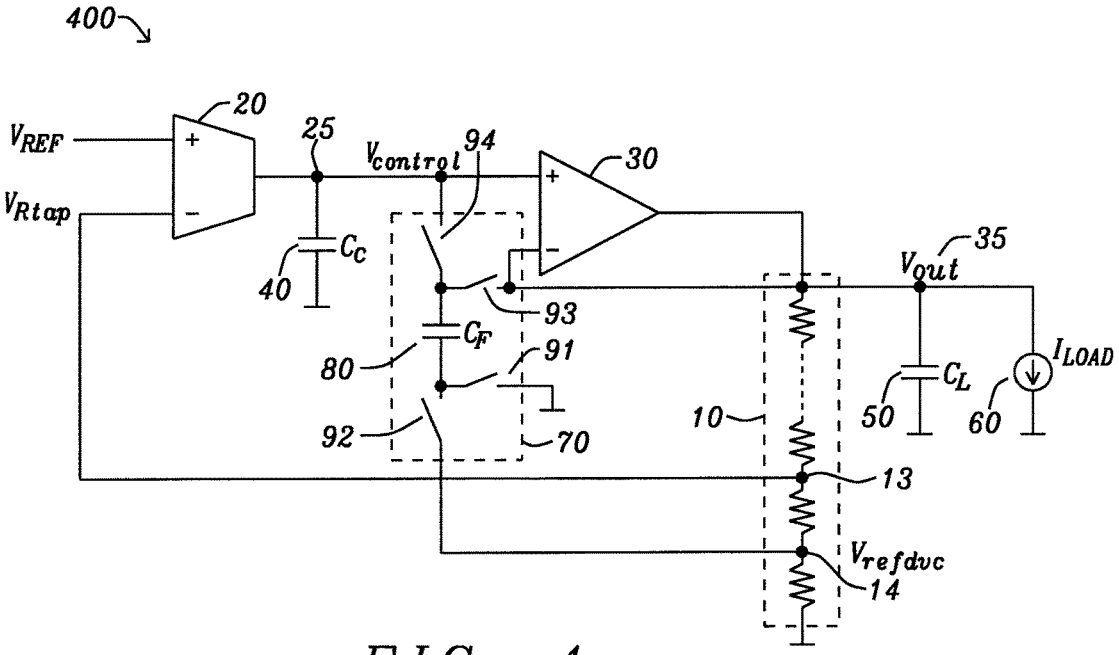

FIG. 4 schematically illustrates another example of a voltage regulator 400 according to embodiments of the disclosure. The voltage regulator 400 of FIG. 4 may be seen as an exemplary, specific implementation of the voltage regulator 300 of FIG. 3. Single or plural details of implementation of the below description may be employed in the context of the voltage regulator 300 of FIG. 3, without the necessity to employ each and every detail of implementation. Some of these details of implementation relate to the charge injection circuit 70. Moreover, unless indicated otherwise, like-numbered elements in FIG. 3 and FIG. 4 are identical and repeated description thereof is omitted for reasons of conciseness.

The voltage regulator 400 differs from the voltage regulator 200 in FIG. 2 by comprising the charge injection circuit 70 for injecting or taking out charge (i.e., electric charge) at the intermediate node 25. In general, the charge injection circuit 70 may be said to inject charge. In particular, the charge injection circuit may be said to inject negative charge or (virtually) inject positive charge, the latter corresponding to taking out negative charge. The arrangement (e.g., coupling) and operation of the charge injection circuit 70 may be identical to the arrangement (e.g., coupling) and operation of the charge injection circuit 70 in FIG. 3. It is to be understood that FIG. 4 shows a specific exemplary implementation of the charge injection circuit 70.

Accordingly, the charge injection circuit 70 may include a (first) capacitive element 80 ($C_F$). The first capacitive element 80 may include, or be, a capacitor. The charge injection circuit 70 may further include a switching circuit (e.g., an assembly of switching elements). The switching circuit may be switchable to a first configuration and a second configuration. In the first configuration of the switching circuit, the first capacitive element 80 may be disconnected from the intermediate node 25 and coupled (e.g., connected) between the voltage level of the output voltage $V_{out}$ and the first voltage level. The first voltage level may be below the voltage level of the output voltage $V_{out}$. The first voltage level may be ground, for example. In the second configuration of the switching circuit, the first capacitive element 80 may be coupled (e.g., connected) between the intermediate node 25 and a second voltage level. The second voltage level may be above the first voltage level. Further, the second voltage level may be below the voltage level of the output voltage $V_{out}$. The second voltage level may be a voltage level of a voltage $V_{refdvc}$ output by the switchable voltage divider circuit 10. Alternatively, the second voltage level may be a predetermined voltage level of a voltage output by a reference voltage supply, for example.

The switching circuit may be further switchable to a third configuration and a fourth configuration. In the third configuration of the switching circuit, the first capacitive element 80 may be disconnected from the intermediate node 25 and coupled (e.g., connected) between the voltage level of the output voltage $V_{out}$ and the second voltage level. In the fourth configuration of the switching circuit, the first capacitive element may be coupled (e.g., connected) between the intermediate node 25 and the first voltage level.

In embodiments, the switching circuit may include first to fourth switching elements 91, 92, 93, 94, such as switches, for example, (e.g., controllable switches). The first to fourth switching elements 91, 92, 93, 94 may include, or be, transistors, for example. The first switching element 91 may be configured (e.g., arranged) for switchably coupling (e.g., connecting) a first terminal of the first capacitive element 80 to the first voltage level. The second switching element 92 may be configured (e.g., arranged) for switchably coupling (e.g., connecting) the first terminal of the first capacitive element 80 to the second voltage level. For example, the second switching element 92 may be coupled (e.g., connected) between the first terminal of the first capacitive element 80 and an additional tap (second intermediate node) 14 of the switchable voltage divider circuit 10. The third switching element 93 may be configured (e.g., arranged) for switchably coupling (e.g., connecting) a second terminal of the first capacitive element 80 to the voltage level of the output voltage $V_{out}$. The fourth switching element 94 may be configured (e.g., arranged) for switchably coupling (e.g., connecting) the second terminal of the first capacitive element 80 to the intermediate node 25.

For the first configuration of the switching circuit, the first and third switching elements 91, 93 may be closed (i.e., may allow a current to pass), and the second and fourth switching elements 92, 94 may be open (i.e., may substantially block currents). In the second configuration, the first and third switching elements 91, 93 may be open and the second and fourth switching elements 92, 94 may be closed. In the third configuration, the second and third switching elements 92, 93 may be closed and the first and fourth switching elements 91, 94 may be open. Lastly, in the fourth configuration, the second and third switching elements 92, 93 may be open and the first and fourth switching elements 91, 94 may be closed. Here, the closed state of a switching element is understood to refer to a conducting state, and the open state of a switching element is understood to refer to a substantially non-conducting state. The first to fourth switching elements may be implemented by transistors, for example, as indicated above.

The voltage regulator 400 may further include a second capacitive element 40 connected between the intermediate node 25 and a predetermined voltage level. The second capacitive element may be the compensation capacitive element 40 described above in the context of FIG. 1. The predetermined voltage level may be the first voltage level (e.g., ground). The first capacitive element 80 may have a smaller capacitance than the second capacitive element 40. For example, the capacitance (capacitance value) $C_C$ of the second capacitive element 40 may be larger than the capacitance (capacitance value) $C_F$ of the first capacitive element 80 by a factor of 10 or more. In embodiments, for example, the capacitance $C_C$ of the second capacitive element 40 may be larger than the capacitance $C_F$ of the first capacitive element 80 by a factor of between 25 and 45. As will be described below, the relative sizes of capacitances of the first and second capacitive elements 80, 40 may set the size of the increase or decrease $\Delta V_{control}$ of the control voltage $V_{control}$ resulting from charge injection.

The voltage regulator 400 may further include a control logic (not shown in FIG. 4) for controlling the switching circuit. The control logic may periodically switch the switching circuit between the first configuration and the second configuration while the feedback voltage $V_{Rtap}$ is below the reference voltage $V_{REF}$ (i.e., while the output voltage $V_{out}$ is desired to be raised). Also, the control logic may periodically switch the switching circuit between the third configuration and the fourth configuration while the feedback voltage $V_{Rtap}$ is above the reference voltage $V_{REF}$ (i.e., while the output voltage $V_{out}$ is desired to be lowered). The control logic may be implemented by a digital control block of a PMIC comprising the voltage regulator 400.

Figure 5A:
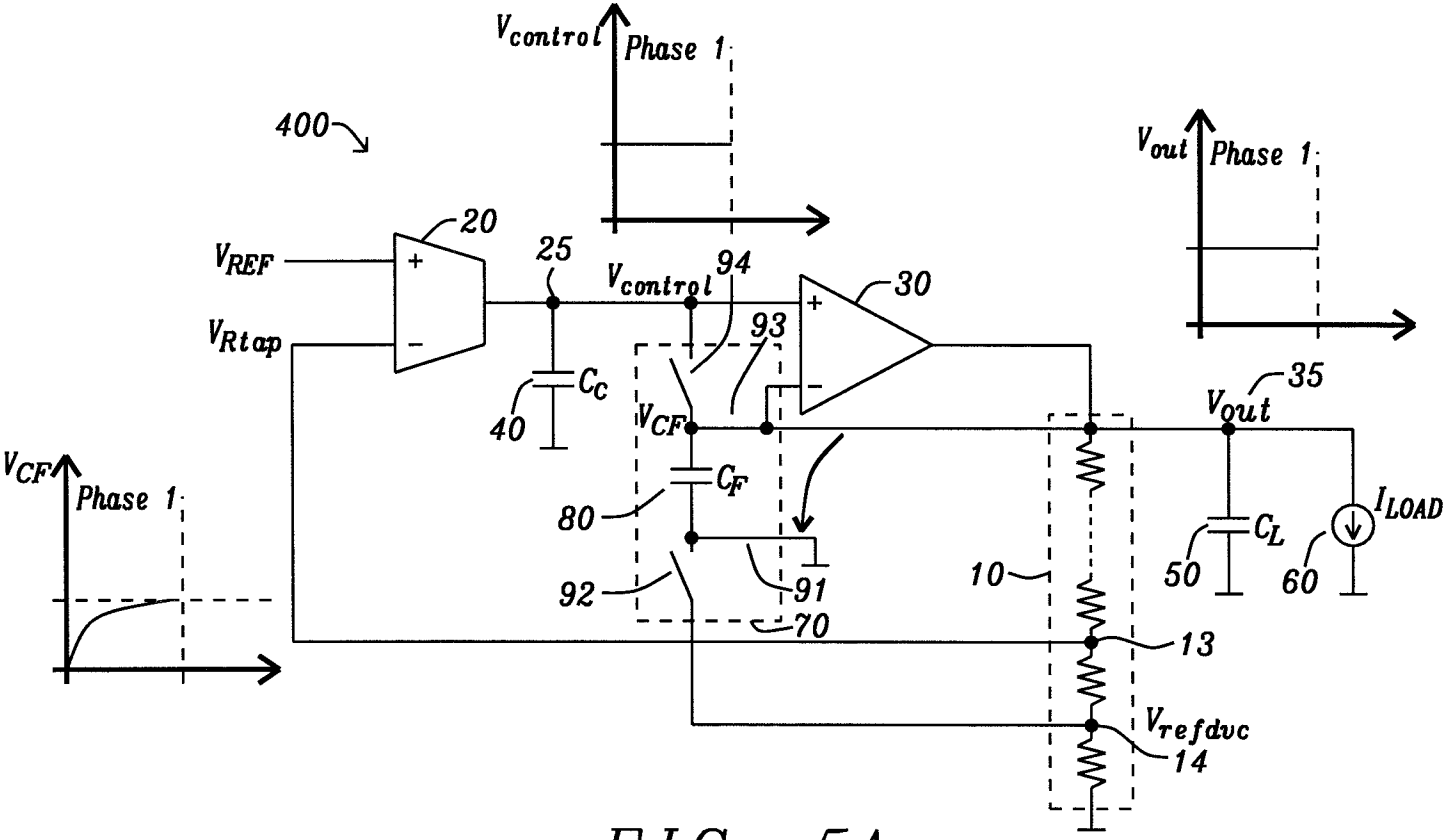
Figure 5B:
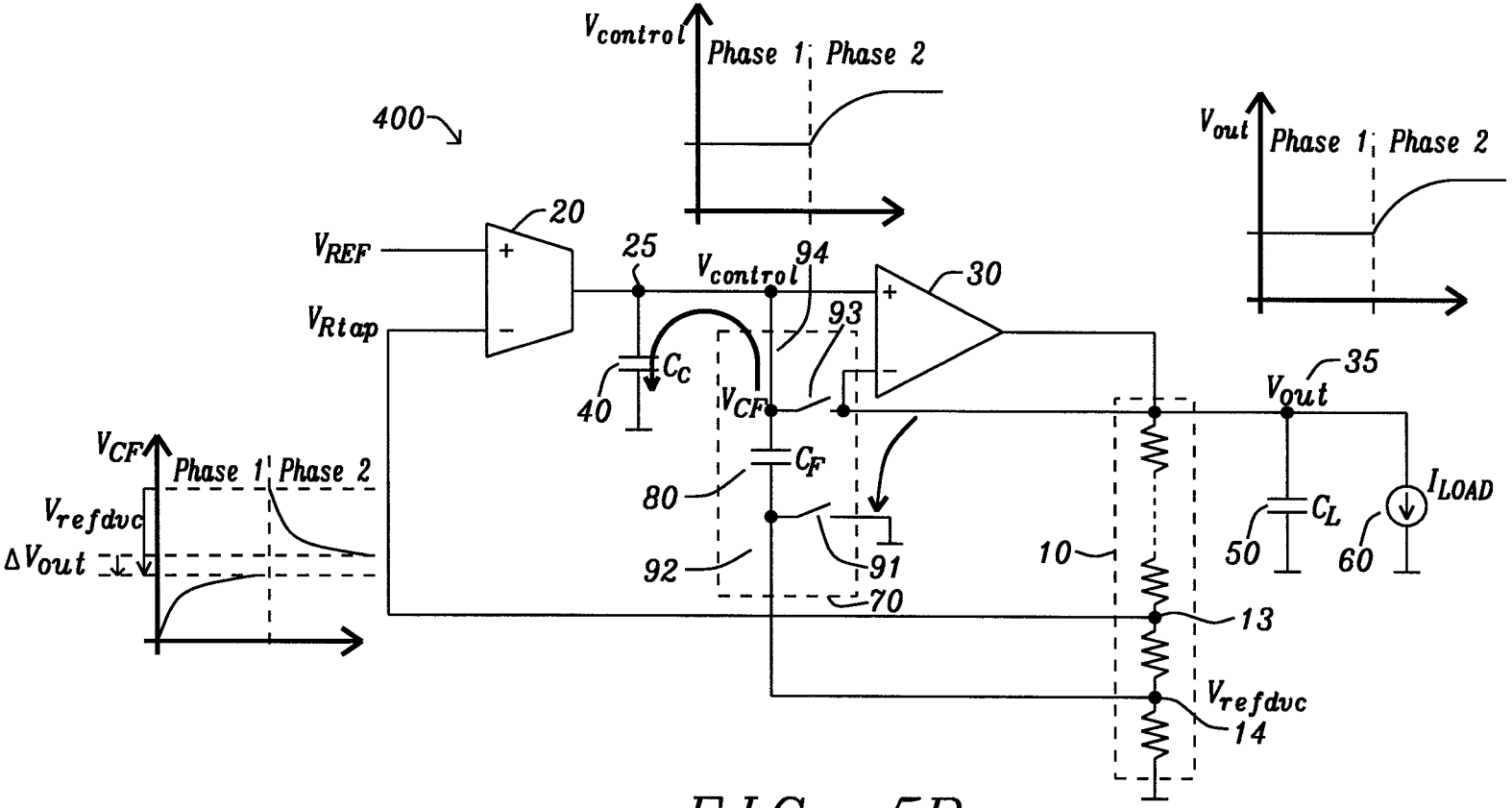
Figure 6A:
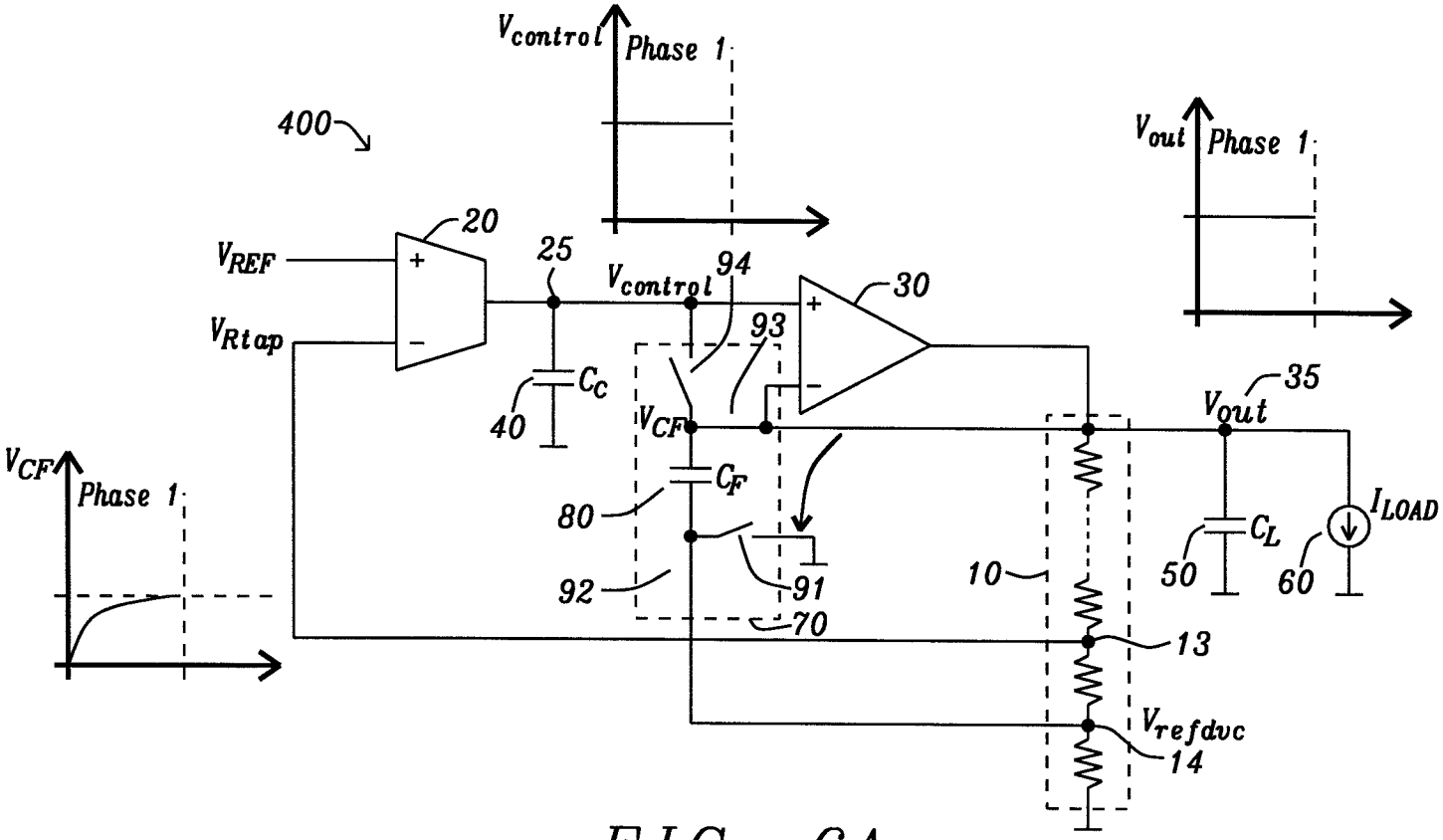
Figure 6B:
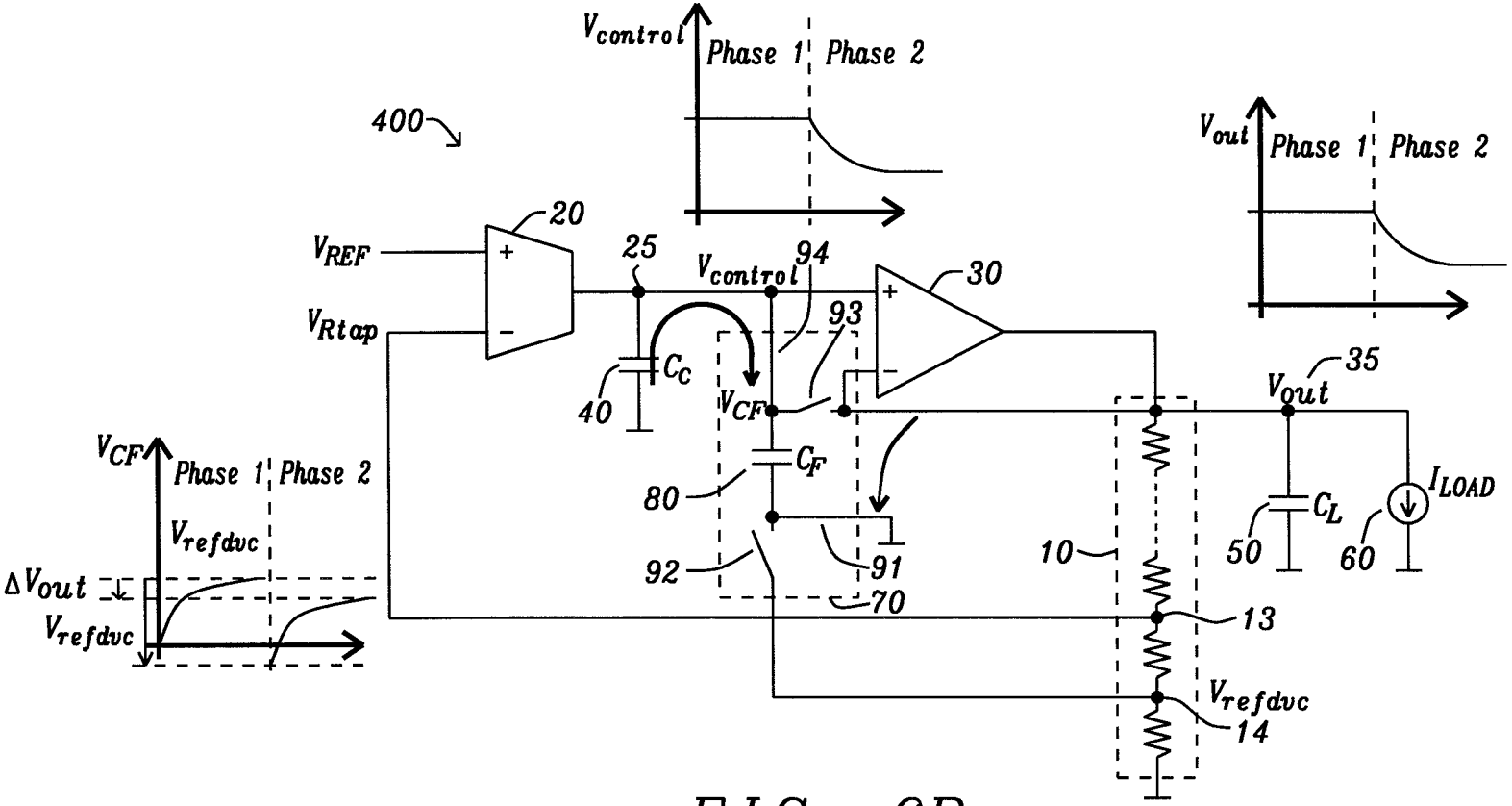

Operation (such as DVC operation, for example) for increasing or decreasing the output voltage $V_{out}$ may consist of two phases each. The respective two phases may be alternatingly repeated until the desired target voltage has been reached. Repetition may be performed in a periodic manner, such as on the basis of a clock signal, for example. Moreover, repetition may be performed under control of the control logic. FIG. 5A and FIG. 5B schematically illustrate an example of the respective two phases of operation of the voltage regulator 400 of FIG. 4 for a desired target voltage above the current output voltage (voltage up operation, e.g., DVC up operation). FIG. 6A and FIG. 6B schematically illustrate an example of the respective two phases of operation of the voltage regulator 400 for a desired target voltage below the current output voltage (voltage down operation, e.g., DVC down operation).

FIG. 5A schematically illustrates the switch configuration and corresponding voltages for the first phase (phase 1) of raising the output voltage $V_{out}$ (voltage up operation, e.g., DVC up operation). During this phase, which may be referred to as charging phase, the switching circuit may be in the first configuration. Accordingly, the first and third switching elements 91, 93 may be closed and the second and fourth switching elements 92, 94 may be open. Thus, the first capacitive element 80 may be coupled (e.g., connected) between ground (as an example of the first voltage level) and the voltage level of the output voltage $V_{out}$, and may be charged up to the output voltage $V_{out}$. Thus, the voltage $V_{CF}$ across the first capacitive element 80 will rise. The current flow during this phase is indicated by the bent arrow in FIG. 5A (notably, electrons will flow in the opposite direction). On the other hand, the control voltage $V_{control}$ and the output voltage $V_{out}$ may remain unchanged during this phase.

FIG. 5B schematically illustrates the switch configuration and corresponding voltages for the second phase (phase 2) of raising the output voltage $V_{out}$ (voltage up operation, e.g., DVC up operation). During this phase, which may be referred to as discharging phase, the switching circuit may be in the second configuration. Accordingly, the first and third switching elements 91, 93 may be open and the second and fourth switching elements 92, 94 may be closed. Thus, the first capacitive element 80 may be coupled (e.g., connected) between the intermediate node 25 and the second voltage level $V_{refdvc}$. Since the second voltage level $V_{refdvc}$ is above ground (as an example of the first voltage level), the voltage $V_{CF}$ on the first capacitive element 80 is boosted by up by the second voltage $V_{refdvc}$ (in general, by the difference between the second voltage and the first voltage if the first voltage level is different from the ground voltage level). Therefore, the first capacitive element 80 may be discharged over the fourth switching element 94 to the second capacitive element 40. The current flow during this phase is indicated by the bent arrow in FIG. 5B (notably, electrons will flow in the opposite direction). At the same time, the control voltage $V_{control}$ increases due to the electric charge shared between the first and second capacitive elements 80, 40. In particular, a voltage change of the control voltage $V_{control}$ (resulting voltage change at the end of the second phase) may be given by $$\Delta V_{control}=\Delta V_{out}=C_F/(C_C+C_F)\cdot V_{refdvc}.$$

For the first voltage level different from ground, $V_{refdvc}$ in the above equation would need to be replaced by the difference between the second voltage level and the first voltage level.

As can be seen from the above equation, the step size by which the control voltage $V_{control}$ is changed (i.e., increased in the present case) is set by the second voltage (in general, by the difference between the second voltage and the first voltage if the first voltage level is different from the ground voltage level) and the ratio between the capacitance $C_F$ of the first capacitive element 80 and the sum of the capacitances $C_F$ and $C_C$ of the first and second capacitive elements 80, 40.

The buffer stage 30 will drive the load capacitance (i.e., the output voltage $V_{out}$) to follow the control voltage $V_{control}$.

As indicated above, the first and second phases of operation (voltage up operation, e.g., DVC up operation) may be alternatingly repeated until the output voltage $V_{out}$ is increased up to the desired target voltage.

FIG. 6A schematically illustrates the switch configuration and corresponding voltages for the first phase (phase 1) of lowering the output voltage $V_{out}$ (voltage down operation, e.g., DVC down operation). During this phase, which may be referred to as charging phase, the switching circuit may be in the third configuration. Accordingly, the second and third switching elements 92, 93 may be closed and the first and fourth switching elements 91, 94 may be open. Thus, the first capacitive element 80 may be coupled (e.g., connected) between the second voltage level $V_{refdvc}$ and the voltage level of the output voltage $V_{out}$ and may be charged up to the output voltage $V_{out}$. Thus, the voltage $V_{CF}$ across the first capacitive element 80 will rise. The current flow during this phase is indicated by the bent arrow in FIG. 6A. On the other hand, the control voltage $V_{control}$ and the output voltage $V_{out}$ may remain unchanged during this phase.

FIG. 6B schematically illustrates the switch configuration and corresponding voltages for the second phase (phase 2) of lowering the output voltage $V_{out}$ (voltage down operation, e.g., DVC down operation). During this phase, which may be referred to as discharging phase, the switching circuit may be in the fourth configuration. Accordingly, the second and third switching elements 92, 93 may be open and the first and fourth switching elements 91, 94 may be closed. Thus, the first capacitive element 80 may be coupled (e.g., connected) between the intermediate node 25 and ground (as an example of the first voltage level). Since the first voltage level is below the second voltage level, the voltage on the first capacitive element 80 is boosted down by a difference between the second voltage $V_{refdvc}$ and the first voltage (e.g., ground). For the first voltage corresponding to ground, the voltage on the first capacitive element 80 is boosted down by the second voltage $V_{refdvc}$. Therefore, the second capacitive element 40 may be discharged, over the fourth switching element 94, to the first capacitive element 80. The current flow of during this phase is indicated by the bent arrow in FIG. 6B. At the same time, the control voltage $V_{control}$ decreases due to the electric charge shared between the first and second capacitive elements 80, 40. In particular, a voltage change of the control voltage $V_{control}$ (resulting voltage change at the end of the second phase) may be given by $$V_{control}=\Delta V_{out}=-C_F/(C_C+C_F)\cdot V_{refdvc}.$$

For the first voltage level different from ground, $V_{refdvc}$ in the above equation would need to be replaced by the difference between the second voltage level and the first voltage level.

Also here, the buffer stage 30 will drive the load capacitance (i.e., the output voltage $V_{out}$) to follow the control voltage $V_{control}$.

As indicated above, the first and second phases of operation (voltage down operation, e.g., DVC down operation) may be alternatingly repeated until the output voltage $V_{out}$ is decreased down to the desired target voltage.

Figure 7A:
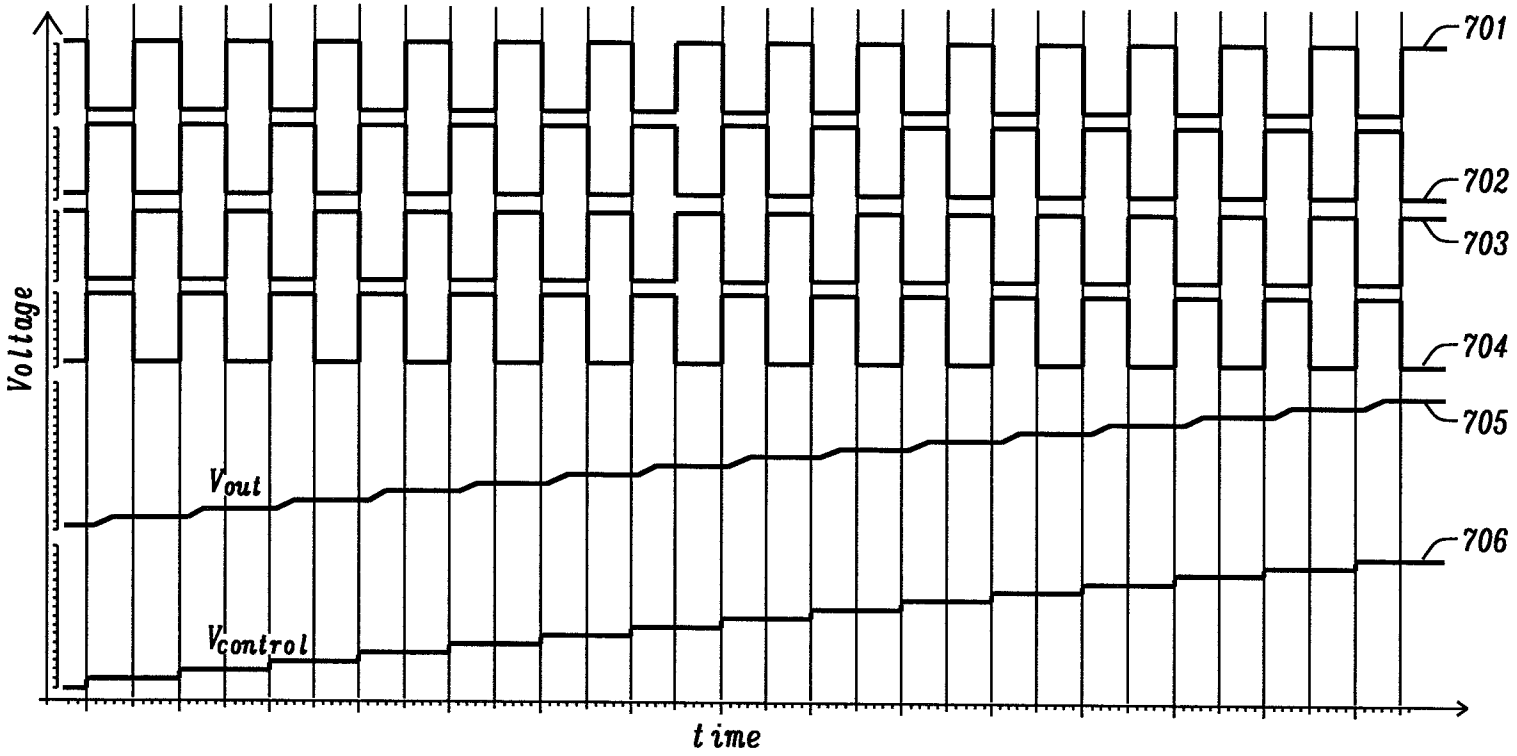
FIG. 7A and FIG. 7B are time charts schematically illustrating voltage levels and control signal levels in the circuit of FIG. 4, and FIG. 8 schematically illustrates yet another example of a circuit for generating an output voltage and regulating the output voltage to a target voltage according to embodiments of the disclosure.
Figure 7B:
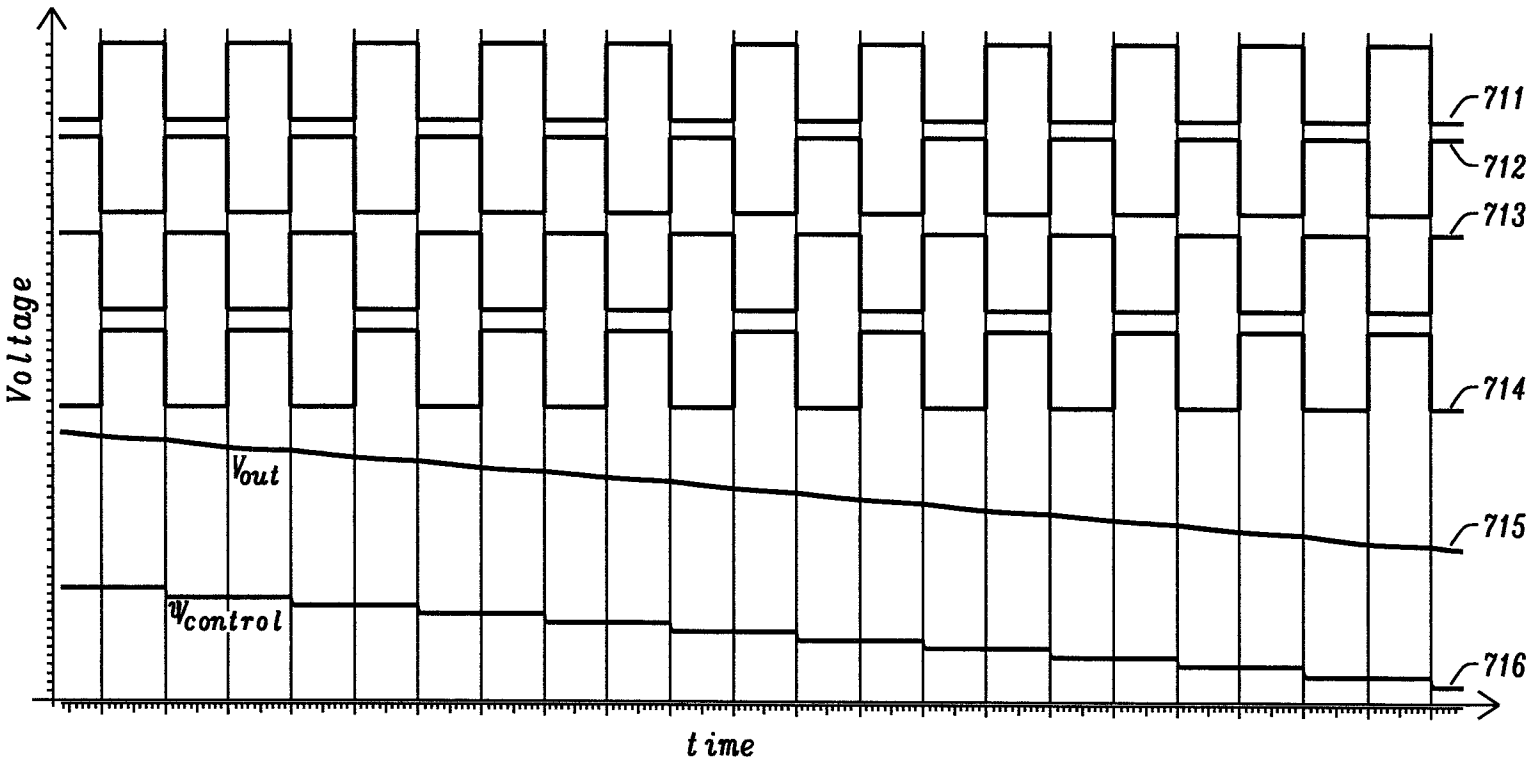

FIG. 7A and FIG. 7B are time charts schematically illustrating voltage levels of the control voltage $V_{control}$ and the output voltage $V_{out}$ as well as control signal levels for the first to fourth switching elements 91-94 in the voltage regulator 400 for voltage up operation and voltage down operation, respectively.

In FIG. 7A, the horizontal axis indicates time in arbitrary units, and the vertical axis indicates voltage in arbitrary units. Graphs 701, 702, 703, and 704, from top to bottom, indicate control signals for the first to fourth switching elements 91-94, respectively. A high level of the control signal indicates a closed state of the respective switching element, and a low level of the control signal indicates an open state of the respective switching element. Graph 705 indicates the voltage level of the output voltage $V_{out}$. Graph 706 finally indicates the voltage level of the control voltage $V_{control}$.

At t=0, the switching circuit of the charge injection circuit 70 is in the first configuration (first phase of voltage up operation): The first and third switching elements 91, 93 are closed, and the second and fourth switching elements 92, 94 are open. During this phase, the first capacitive element 80 is charged and the control voltage $V_{control}$ and the output voltage $V_{out}$ remain substantially constant, apart from comparatively slow regulation by the error amplifier stage. Then, the switching circuit of the charge injection circuit 70 transitions (e.g., is switched) to the second configuration (second phase of voltage up operation): The first and third switching elements 91, 93 are open, and the second and fourth switching elements 92, 94 are closed. During this phase, the first capacitive element 80 is (partially) discharged into the second capacitive element 40 and the control voltage $V_{control}$ is gradually raised up to a total voltage change of $\Delta V_{control}$. The buffer stage 30 drives the output voltage $V_{out}$ to follow the control voltage $V_{control}$. Then, the switching circuit of the charge injection circuit 70 transitions to the first configuration again, and the process repeats. During each full cycle of the first and second phases, the control voltage $V_{control}$ is raised by a total amount of $V_{control}$ that is determined by the capacitances of the first and second capacitive elements 80, 40 and the first and second voltage levels (in particular, a difference between these voltage levels).

In FIG. 7B, graphs 711, 712, 713, and 714, from top to bottom, indicate control signals for the third, first, fourth, and second switching elements 93, 91, 94, 92, respectively. Graph 715 indicates the voltage level of the output voltage $V_{out}$. Graph 716 finally indicates the voltage level of the control voltage $V_{control}$.

At t=0, the switching circuit of the charge injection circuit 70 is in the fourth configuration (second phase of voltage down operation). Then, the switching circuit transitions to the third configuration (first phase of voltage down operation): The second and third switching elements 92, 93 are closed, and the first and fourth switching elements 91, 94 are open. During this phase, the first capacitive element 80 is charged and the control voltage $V_{control}$ and the output voltage $V_{out}$ remain substantially constant, apart from comparatively slow regulation by the error amplifier stage. Then, the switching circuit of the charge injection circuit 70 transitions (e.g. is switched) to the fourth configuration (second phase of voltage down operation): The second and third switching elements 92, 93 are open, and the first and fourth switching elements 91, 94 are closed. During this phase, the second capacitive element 40 is (partially) discharged into the first capacitive element 80 and the control voltage $V_{control}$ is gradually lowered by a total voltage change of $\Delta V_{control}$. The buffer stage 30 drives the output voltage $V_{out}$ to follow the control voltage $V_{control}$. Then, the switching circuit of the charge injection circuit 70 transitions to the third configuration again, and so forth. During each full cycle of the first and second phases, the control voltage $V_{control}$ is lowered by a total amount of $\Delta V_{control}$ that is determined by the capacitances of the first and second capacitive elements 80, 40 and the first and second voltage levels (in particular, a difference between these voltage levels).

Figure 8:
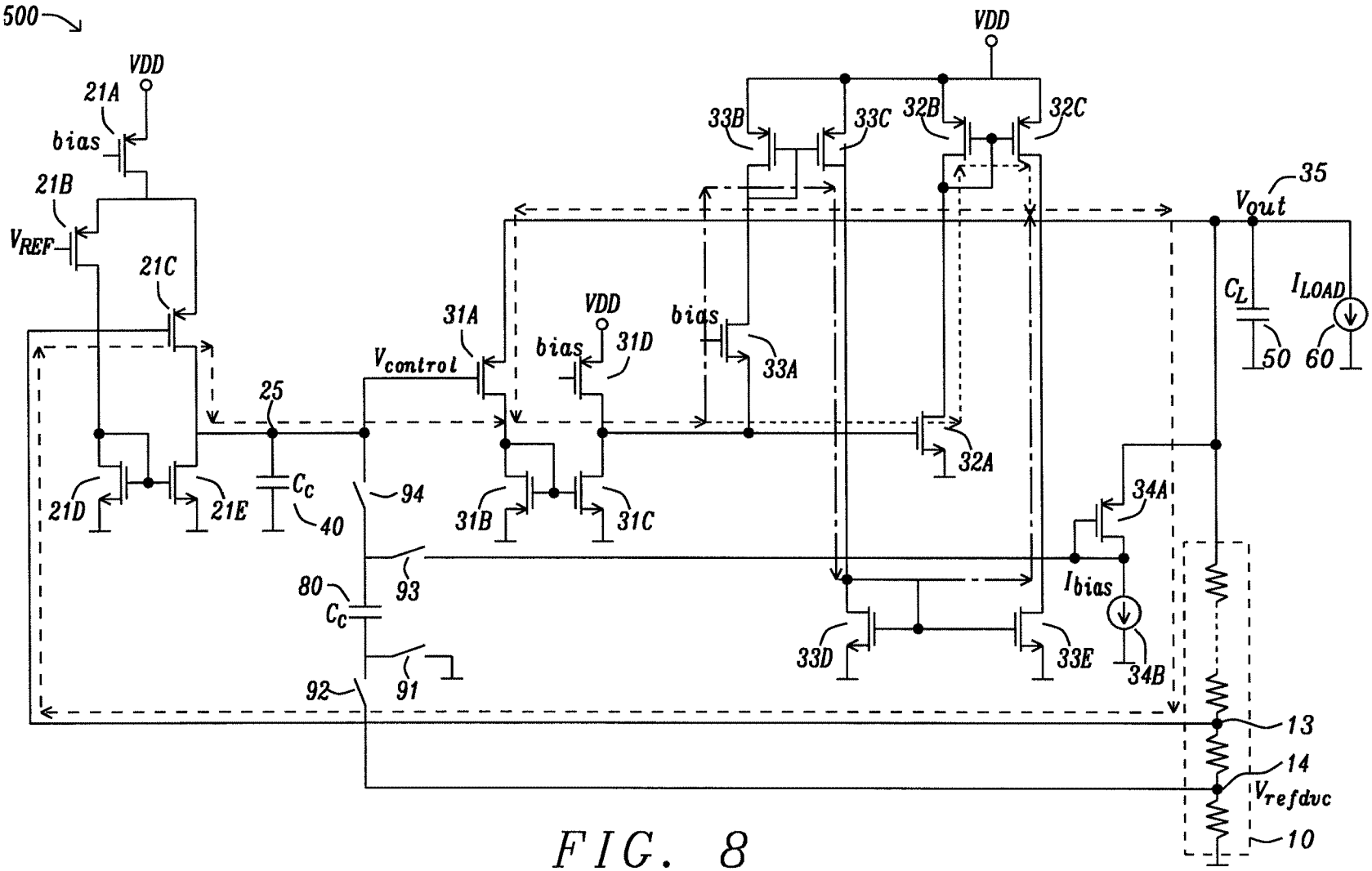

FIG. 8 schematically illustrates yet another example of a voltage regulator 500 according to embodiments of the disclosure. The voltage regulator 500 of FIG. 8 may be seen as an exemplary, specific implementation of the voltage regulators 300, 400 of FIG. 3 and FIG. 4, respectively. Single or plural details of implementation of the below description may be employed in the context of the voltage regulators 300, 400, without the necessity to employ each and every detail of implementation. Some of these details of implementation relate to the switchable voltage divider circuit 10, the error amplifier stage, the buffer stage 30, and the charge injection circuit 70. Moreover, unless indicated otherwise, like-numbered elements in FIG. 3, FIG. 4, and FIG. 8 are identical and repeated description thereof is omitted for reasons of conciseness.

In this specific example, the error amplifier 20 is implemented by transistors 21A, 21B, 21C, 21D, 21E. A bias voltage for the error amplifier 20 may be set at a control terminal (e.g., gate terminal) of transistor 21A. The reference voltage $V_{REF}$ may be input at the control terminal (e.g., gate terminal) of transistor 21B. Further in the specific example, the buffer stage 30 is implemented by transistors 31A, 31B, 31C, 31D, which form the first part of the buffer stage 30 and transistors 32A, 32B, 32C are the second part of the buffer stage 30. This buffer stage 30 is only able to source, but not sink current. Therefore, the sink stage is implemented in a similar manner by reusing the transistors of the first part 31A, 31B, 31C, 31D and adding transistors 33A, 33B, 33C, 33D, 33E for the second part to provide sink capability. Transistor 34A is a replica of Transistor 31A to match the voltage difference between the control voltage $V_{control}$ and the output voltage $V_{out}$. Current source 34B is required to provide bias current for the replica transistor 34A. Transistor 33A determines, based on the output of the first part of the buffer stage formed by transistors 31A, 31B, 31C, 31D and it gate voltage, whether the source stage or the sink stage will be active. The aforementioned transistors may be FET or MOSFET transistors, such as PMOS transistors or NMOS transistors, for example. The main loop comprises the error amplifier stage and the buffer stage. Dotted arrows in FIG. 8 indicate the DVC up path, and dash-dotted arrows indicate the DVC down path. Notably, the voltage regulator 500 has five inversion stages in source or sink mode, thus resulting in negative feedback.

In the voltage regulator 500, transistor 32C implements a source pass device, and transistor 33E implements a sink pass device. Since the sink pass device is smaller than the source pass device, the (absolute value of the) slope of change of the output voltage $V_{out}$ for voltage down operation in FIG. 7B is smaller than the respective slope for voltage up operation in FIG. 7A. Transistor 32B implements a diode with low capacitance.

A voltage offset between the output voltage $V_{out}$ and the control voltage $V_{control}$ (the output voltage $V_{out}$ being lower by the offset voltage than the control voltage $V_{control}$) may result from a threshold voltage of transistor 31A. Notably, such voltage offset may be compensated at transistor 34A.

In alternative embodiments, the charge injection circuit 70 may be implemented by a controllable (e.g., switchable) current source, such as a controllable current source with source/sink capability. The controllable current source may operate under control of the control logic. The controllable current source may be configured to intermittently inject a predetermined (positive or negative) electric charge at the intermediate node 25 while the output voltage $V_{out}$ is desired to be raised or lowered.

It should be noted that the apparatus features described above correspond to respective method features that may however not be explicitly described, for reasons of conciseness. The disclosure of the present document is considered to extend also to such method features. In particular, the present disclosure is understood to relate to methods of operating the circuits described above.

It should further be noted that the description and drawings merely illustrate the principles of the proposed apparatus. Those skilled in the art will be able to implement various arrangements that, although not explicitly described or shown herein, embody the principles of the invention and are included within its spirit and scope. Furthermore, all examples and embodiment outlined in the present document are principally intended expressly to be only for explanatory purposes to help the reader in understanding the principles of the proposed method. Furthermore, all statements herein providing principles, aspects, and embodiments of the invention, as well as specific examples thereof, are intended to encompass equivalents thereof.

What is claimed is:

1. A circuit for generating an output voltage and regulating the output voltage to a target voltage, the circuit comprising:

a switchable voltage divider circuit configured to generate a voltage that is a variable fraction of the output voltage;

an error amplifier stage configured to generate a control voltage on the basis of a reference voltage and the variable fraction of the output voltage;

a buffer stage configured to generate the output voltage on the basis of the control voltage; and a charge injection circuit configured to inject charge at an intermediate node between the error amplifier stage and the buffer stage to thereby modify the control voltage generated by the error amplifier stage, wherein the charge injection circuit is configured to inject the charge at the intermediate node to quickly raise or lower the output voltage to the target voltage; and wherein the charge injection circuit comprises:

a first capacitive element; and a switching circuit configured to be switchable to a first configuration in which the first capacitive element is disconnected from the intermediate node and coupled between the output voltage and a first voltage level below the output voltage, and a second configuration in which the first capacitive element is coupled between the intermediate node and a second voltage level above the first voltage level.

2. The circuit according to claim 1, wherein the charge injection circuit is configured to inject charge at the intermediate node in such a manner that the control voltage is lowered if the variable fraction of the output voltage is larger than the reference voltage and raised if the variable fraction of the output voltage is smaller than the reference voltage.

3. The circuit according to claim 1, further comprising a control logic for periodically switching the switching circuit between the first configuration and the second configuration while the fraction of the output voltage is below the reference voltage.

4. The circuit according to claim 3, wherein the switching circuit is further configured to be switchable to a third configuration in which the first capacitive element is disconnected from the intermediate node and coupled between the output voltage and the second voltage level, and a fourth configuration in which the first capacitive element is coupled between the intermediate node and the first voltage level.

5. The circuit according to claim 4, wherein the control logic is further configured to periodically switch the switching circuit between the third configuration and the fourth configuration while the fraction of the output voltage is above the reference voltage.

6. The circuit according to claim 1, wherein the switching circuit comprises:

a first switching element for switchably coupling a first terminal of the first capacitive element to the first voltage level;

a second switching element for switchably coupling the first terminal of the first capacitive element to the second voltage level;

a third switching element for switchably coupling a second terminal of the first capacitive element to the output voltage; and a fourth switching element for switchably coupling the second terminal of the first capacitive element to the intermediate node.

7. The circuit according to claim 1, further comprising a second capacitive element coupled between the intermediate node and a predetermined voltage level.

8. The circuit according to claim 7, wherein a capacity of the second capacitive element is larger than a capacity of the first capacitive element by a factor of ten or more.

9. The circuit according to claim 1, wherein the charge injection circuit comprises a controllable current source.

10. A method of generating an output voltage and regulating the output voltage to a target voltage, the method comprising:

generating a voltage that is a variable fraction of the output voltage in accordance with a control signal depending on a desired target voltage;

generating a control voltage on the basis of a reference voltage and the variable fraction of the output voltage;

buffering the control voltage to generate the output voltage; and modifying the generated control voltage by means of charge injection, wherein the charge injection is performed to quickly raise or lower the output voltage to the target voltage; and wherein charge injection is performed using a first capacitive element and the method further comprises the steps of:

comparing the variable fraction of the output voltage to the reference voltage; and if the fraction of the output voltage is below the reference voltage, periodically switching between a first configuration in which the first capacitive element is disconnected from a voltage level of the control voltage and coupled between the output voltage and a first voltage level below the output voltage, and a second configuration in which the first capacitive element is coupled between the voltage level of the control voltage and a second voltage level above the first voltage level.

11. The method according to claim 10, wherein modifying the control voltage involves lowering the control voltage if the variable fraction of the output voltage is larger than the reference voltage and raising the control voltage if the variable fraction of the output voltage is smaller than the reference voltage.

12. The method according to claim 10, further comprising the steps of:

if the fraction of the output voltage is above the reference voltage, periodically switching between a third configuration in which the first capacitive element is disconnected from the voltage level of the control voltage and coupled between the output voltage and the second voltage level, and a fourth configuration in which the first capacitive element is coupled between the voltage level of the control voltage and the first voltage level.

13. The method according to claim 10, further comprising the steps of:

switching a first switching element that switchably couples a first terminal of the first capacitive element to the first voltage level;

switching a second switching element that switchably couples the first terminal of the first capacitive element to the second voltage level;

switching a third switching element that switchably couples a second terminal of the first capacitive element to the output voltage; and switching a fourth switching element that switchably couples the second terminal of the first capacitive element to the voltage level of the control voltage.

14. The method according to claim 10, wherein charge injection is performed by means of a controllable current source.

15. The method according to claim 11, wherein the charge is injected at an intermediate node, and the method further comprises coupling a second capacitive element between the intermediate node and a predetermined voltage level.

16. The method according to claim 15, wherein a capacity of the second capacitive element is larger than a capacity of the first capacitive element by a factor of ten or more.

17. A method of generating an output voltage and regulating the output voltage to a target voltage, the method comprising:

generating a voltage that is a variable fraction of the output voltage in accordance with a control signal depending on a desired target voltage;

generating a control voltage on the basis of a reference voltage and the variable fraction of the output voltage;

buffering the control voltage to generate the output voltage; and modifying the generated control voltage by means of charge injection, wherein the charge injection is performed to quickly raise or lower the output voltage to the target voltage; wherein the generated control voltage is modified at an intermediate node by means of a charge injection circuit, and wherein the charge injection circuit comprises:

a capacitive element; and a switching circuit which is switchable to a first configuration in which the capacitive element is disconnected from the intermediate node and coupled between the output voltage and a first voltage level below the output voltage, and a second configuration in which the capacitive element is coupled between the intermediate node and a second voltage level above the first voltage level.

18. The method according to claim 17, wherein the switching circuit is switchable to a third configuration in which the capacitive element is disconnected from the intermediate node and coupled between the output voltage and the second voltage level, and a fourth configuration in which the capacitive element is coupled between the intermediate node and the first voltage level.

* * * * *